US005174476A

United States Patent [19]

Steiner et al.

[11] Patent Number: 5,174,476

[45] Date of Patent: Dec. 29, 1992

[54] LIQUID SOAP DISPENSING SYSTEM

[75] Inventors: Robert L. Steiner; Charles R. Holzner, both of Chicago; Allan J. Voth, Oak Park, all of Ill.

[73] Assignee: Steiner Company, Inc., Chicago, Ill.

[21] Appl. No.: 696,070

[22] Filed: May 6, 1991

[51] Int. Cl.[5] ..... B67D 5/00

[52] U.S. Cl. ..... 222/181; 222/189; 222/207; 222/481

[58] Field of Search ..... 222/189, 181, 185, 478, 222/481, 207, 209, 212, 214, 490, 494

[56] References Cited

U.S. PATENT DOCUMENTS

| | | | |
|---|---|---|---|
| 1,234,089 | 7/1917 | Reinhardt | 222/481 X |
| 2,812,117 | 11/1957 | Butkus et al. | 222/481 X |
| 4,533,068 | 8/1985 | Meierhoefer | 222/481 X |
| 4,646,945 | 3/1987 | Steiner et al. | 222/207 |
| 4,660,733 | 4/1987 | Snyder et al. | 222/185 X |
| 4,673,109 | 6/1987 | Cassia | 222/153 |
| 4,699,296 | 10/1987 | Schrock, Jr. | 222/478 X |
| 4,792,059 | 12/1988 | Keiner et al. | 222/189 X |
| 4,834,267 | 5/1989 | Schroer et al. | 222/189 X |
| 4,886,192 | 12/1989 | Cassia | 222/181 |
| 4,930,667 | 6/1990 | Holzner, Sr. | 222/189 |
| 4,964,544 | 10/1990 | Hanna et al. | 222/181 |

FOREIGN PATENT DOCUMENTS

| | | | |
|---|---|---|---|
| 701809 | 1/1954 | United Kingdom | 222/181 |

*Primary Examiner*—Andres Kashnikow
*Assistant Examiner*—Anthoula Pomrening
*Attorney, Agent, or Firm*—Emrich & Dithmar

[57] ABSTRACT

A liquid soap dispensing system includes a housing and a discharge mechanism for dispensing repeated doses of liquid soap from an associated cartridge. A receptacle is positioned in the cartridge wall forming an air path between the inside and outside of the cartridge, and a plastic filter is frictionally disposed within the receptacle for permitting air to flow into the cartridge but preventing soap from flowing out of the cartridge. The filter permits sufficient air flow into the cartridge to limit the vacuum therein to not greater than about 12" upon repeated operation of the discharge mechanism to prevent the cartridge walls from distorting.

18 Claims, 3 Drawing Sheets 22
30
32
37
39
54
46
41
88
88
113
89a
70
39a
89c
89
89b
89d
89e
37
46
31
34

91
94b
93
88
89
54
34
116
37
37
48
31
48a
45
31
66
63
42
43
110

91
94b
89
94a
93
88
38
54
67
68
62
116
34
53
37
72
46
47
55
73
48
49
56
70
82
81
40
86
110
80
41
52
87
42
44
43
113

LIQUID SOAP DISPENSING SYSTEM

BACKGROUND OF THE INVENTION

The present invention relates to apparatus for dispensing liquid soap, normally in discrete small quantities or charges. Such dispensing apparatus is used particularly for hygienic purposes, in public or institutional washrooms or the like or wherever there are a relatively large number of different users.

The invention is an improvement over the device disclosed in U.S. patent application Ser. No. 517,244 filed May 1, 1990, entitled "Liquid Dispensing System Including a Discharge Assembly Providing A Positive Air Flow Condition", the entire disclosure of which including all drawing figures is incorporated by reference.

One prior type of soap dispenser utilizes a container or cartridge of liquid soap which is removably mounted on a dispensing apparatus so that it can be replaced by another cartridge when it is empty. Such a dispenser is disclosed in U.S. Pat. No. 1,326,880. However, the soap container of that dispenser is of the refillable type. This means that the spent containers must be collected, sterilized and refilled and sealed for reuse, which is a time consuming and expensive operation. Because the container is refillable, it has a refill opening which, although normally closed, is accessible to users and could permit contamination of the contents or refilling with soap from an unauthorized source. Furthermore, the container is readily removable from the dispenser by any user, so that the entire container could easily be replaced by a "bootleg" container.

To avoid this problem, it is known to provide dispensers with closed, lockable cabinets in which the refill cartridge or container is enclosed, so as to prevent access by unauthorized persons. But this type of housing is relatively expensive. Furthermore, such prior dispensers have relatively complex construction, frequently using a large number of parts, the assembly of which entails substantial labor.

Efforts have been made to simplify the design of soap dispensers with replaceable cartridges while retaining the ability to restrict access to the dispenser, for instance refer to U.S. Pat. Nos. 4,673,109 and 4,886,192. While solving the problem of design simplification for easier maintenance as illustrated in the construction of the '109 and '192 patents, there has arisen the problem of dispensing doses of soap upon rapid and repeated (5–15) compressions of the nipple.

Repeated attempts to solve this problem of increasing suction are evidenced by U.S. Pat. Nos. 4,646,945, 4,673,109, 4,930,667 and application Ser. No. 517,244 by Steiner Company, Inc., but have not proven completely successful. No matter how many different attempts have been made, the result has always been subject to commercial problems.

SUMMARY OF THE INVENTION

It is a general object of the present invention to provide an improved liquid soap dispensing system which avoids the disadvantages of prior dispensing apparatus while affording additional structural and operating advantages.

An important object of the invention is the provision of a liquid soap dispensing system which is of simple and economical construction, characterized by a minimal number of parts and great ease of assembly which may be repeatedly operated without creating unwanted suction inside the soap cartridge.

Another object of the invention is the provision of a dispensing system of the type set forth, which utilizes a disposable refill cartridge and which is characterized by ease and simplicity of mounting and demounting of the cartridge even with an "anti-bootleg" device built in.

In connection with the foregoing objects, it is another object of the invention to provide a dispensing system of the type set forth, wherein the cartridge is automatically locked in place on the dispenser, provided only that the appropriate cartridge is used for the dispenser.

Yet another object of the invention is the provision of a unique dispenser for use in such a dispensing system.

Another object of the invention is the provision of a unique disposable cartridge for use in such a dispensing system.

Another object of the invention is to provide a liquid soap dispensing system including a housing and a discharge mechanism carried thereby for movement between a normal retracted configuration and an actuating configuration for dispensing repeated doses of liquid soap from an associated cartridge, the improvement comprising: a receptacle positioned in the cartridge wall forming an air path between the inside and outside of the cartridge, a plastic filter frictionally disposed within the receptacle for permitting air to flow into the cartridge but preventing soap from flowing out of the cartridge, the filter permitting sufficient air flow to limit the vacuum in the cartridge to not greater than about 12" upon repeated operation of the discharge mechanism.

Another object of the invention is to provide a liquid soap dispenser having only a minimal number of parts which can be assembled without the use of fastening means for dispensing repeated doses of liquid soap from an associated cartridge with a compressible outlet nipple without collapsing the side walls of the cartridge, the dispenser comprising a housing member adapted to receive the associated cartridge with the nipple, a pump member freely receivable in housing member and movable therein between a pumping position for compressing the nipple to discharge liquid soap therefrom and a release position out of engagement with the nipple, a handle member carried by the housing member in a supported condition for engagement with the pump member, the handle member in its supported condition being pivotally movable between an actuating position for driving the pump member to its pumping position and a retracted position for accommodating movement of the pump member to its release position, the pump member in its pumping position accommodating free movement of the handle member to and from its supported condition on the housing member, the pump member and the handle member cooperating when engaged to retain the pump member in the receptacle and to retain the handle member in its supported condition, and a bias unit engageable with the housing member and the pump member for resiliently urging the pump member to its release position and into engagement with the handle member, thereby to urge the handle member to its retracted position, the cartridge including a blow molded thin walled plastic container with an externally threaded neck for receiving the compressible nipple thereon, a receptacle positioned in the rear wall of the cartridge adapted to receive a filter therein, a plastic filter in the receptacle establishing an air path between the inside and outside of the cartridge, the filter having an average pore diameter of about 25 microns such that upon repeated activation of the pump member the vacuum inside the cartridge does not exceed 12".

Another object of the invention is to provide a liquid soap dispenser for dispensing repeated doses of liquid soap from an associated cartridge with a compressible outlet nipple without collapsing the side walls of the cartridge, the dispenser comprising a housing member adapted to receive the associated cartridge with the nipple, a pump member freely receivable in housing member and movable therein between a pumping position for compressing the nipple to discharge liquid soap therefrom and a release position out of engagement with the nipple, a handle member carried by the housing member in a supported condition for engagement with the pump member, the handle member in its supported condition being pivotally movable between an actuating position for driving the pump member to its pumping position and a retracted position for accommodating movement of the pump member to its release position, the pump member in its pumping position accommodating free movement of the handle member to and from its supported condition on the housing member, the pump member and the handle member cooperating when engaged to retain the pump member in the receptacle and to retain the handle member in its supported condition, a bias unit engageable with the housing member and the pump member for resiliently urging the pump member to its release position and into engagement with the handle member, thereby to urge the handle member to its retracted position, a horizontally extending plate having an irregularly shaped aperture therein fixedly mounted in the housing spaced from the nipple with a portion of the aperture in registry with the nipple, the cartridge comprising a blow molded thin walled plastic container with a parallelepiped body portion and an externally threaded cylindrical neck extending therefrom and connected to the compressible nipple, a receptacle positioned in the rear wall of the cartridge adapted to receive a filter therein, a polytetrafluoroethylene plastic filter in the receptacle establishing a air pathway between the inside and outside of the cartridge for preventing a vacuum exceeding 12" from developing inside the cartridge upon repeated successive operation of the pump member, the cartridge having a frustoconical portion connecting the cylindrical neck to the body portion and at least one boss extending perpendicularly to the neck portion intersecting the frustoconical portion, the irregularly shaped aperture forming a seat to receive therein the cartridge frustoconical portion and the boss extending therefrom and to position the cartridge such that the nipple is in position to be contacted by the pump member.

Other objects of the invention are attained by providing a disposable refill cartridge for a liquid soap dispenser, the cartridge comprising a closed container having a bottom wall portion and a rear wall portion and two opposed side wall portions, an outlet opening formed in a cylindrical neck extending from the bottom wall portion, a frustoconical portion intermediate the bottom wall and the cylindrical neck, at least one boss extending outwardly from the frustoconical portion and said cylindrical neck, two elongated recesses respectively formed in the side wall portions adjacent to the rear wall portion, each of the recesses extending downwardly to the bottom wall portion, the container having stepped retaining surfaces at the upper end of the rear wall portion and at the lower ends of the side wall portions, and a receptacle formed in the rear wall having an apertured end wall.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figure 1:
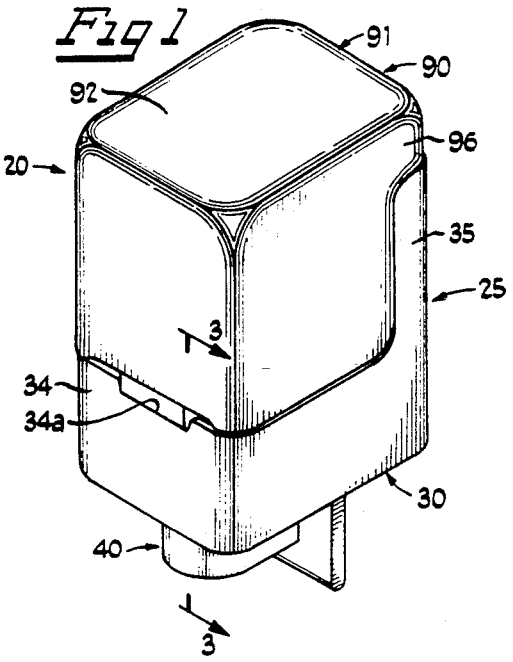
FIG. 1 is a perspective view of a soap dispensing system, constructed in accordance with and embodying the features of the present invention.
Figure 2:
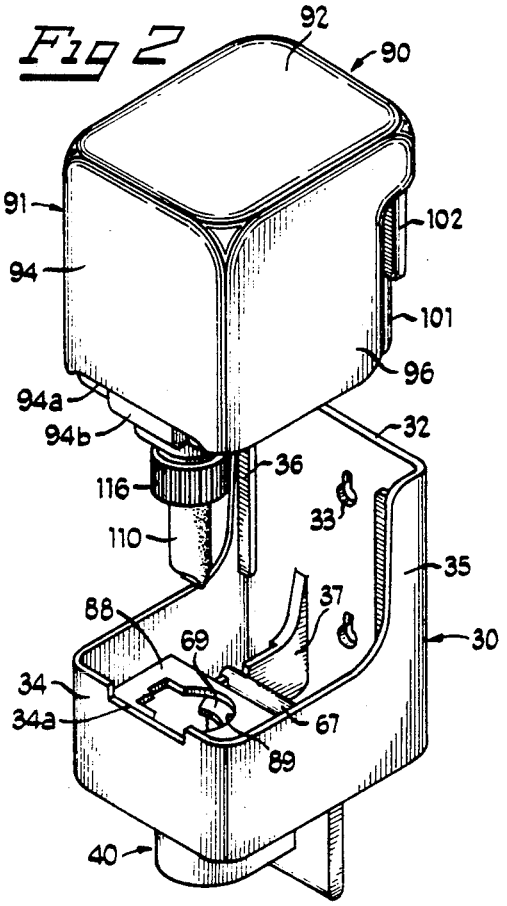
FIG. 2 is an exploded, perspective view of the soap dispensing system of FIG. 1.
Figure 3:
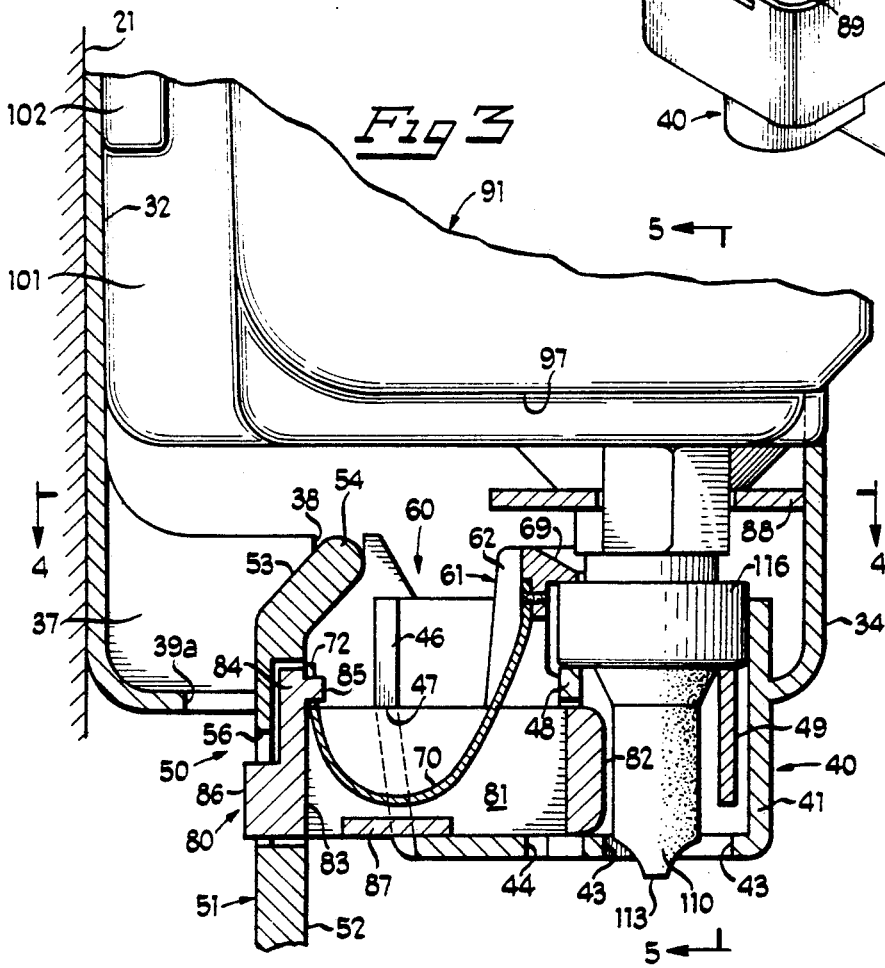
FIG. 3 is a further enlarged, fragmentary view in vertical section taken along the line 3—3 in FIG. 1, and illustrating the discharge assembly in its normal rest configuration.
Figure 4:
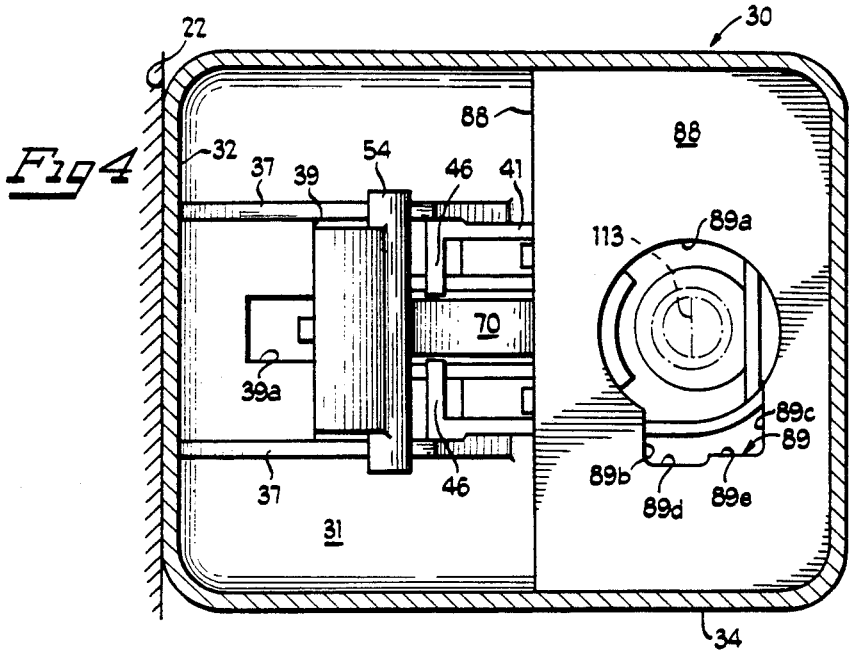
FIG. 4 is a view in horizontal section taken along the line 4—4 in FIG. 3.
Figure 5:
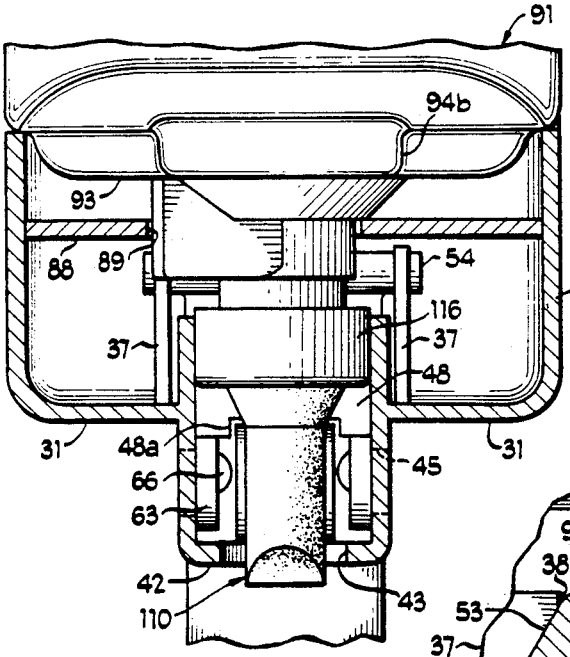
FIG. 5 is a view in vertical section taken along the line 5—5 in FIG. 3.
Figure 6:
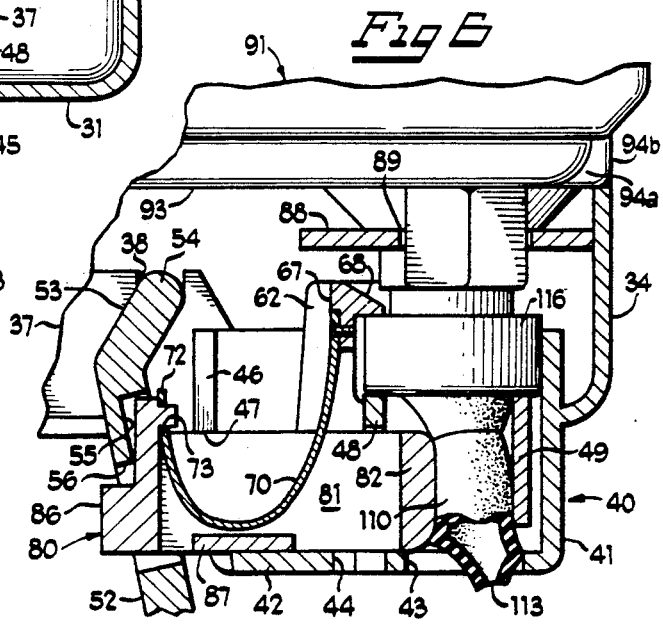
FIG. 6 is a fragmentary view of the lower right hand portion of FIG. 3, illustrating the discharge assembly in its actuating configuration.
Figure 7:
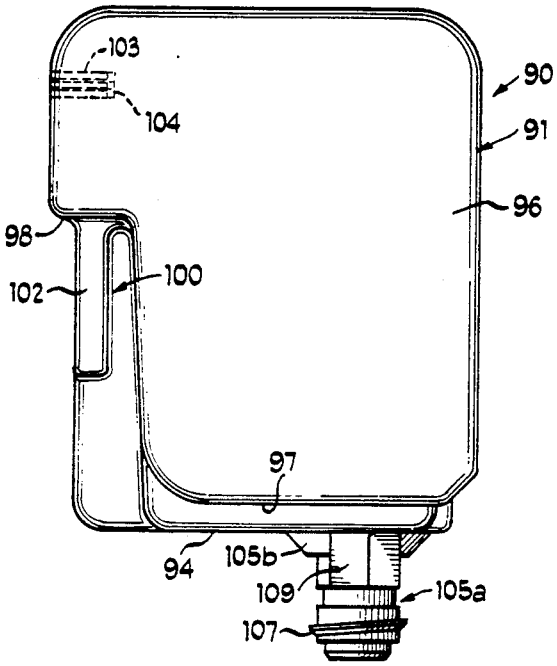
FIG. 7 is a side elevational view of the disposable cartridge of FIG. 2.
Figure 8:
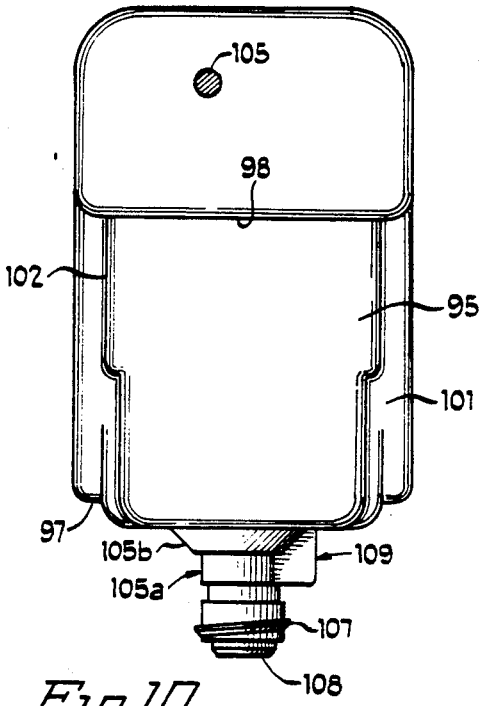
FIG. 8 is a rear elevational view of the disposable cartridge of FIG. 7
Figure 9:
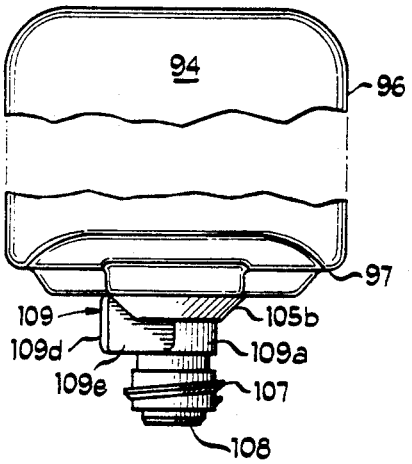
FIG. 9 is a compressed front elevational view of the dispenser cartridge of FIG. 7.

Referring to FIGS. 1 and 2 there is illustrated a soap dispensing system, generally designated by the numeral 20, constructed in accordance with and embodying the features of the present invention. The soap dispensing system 20 comprises a dispenser 25 adapted to be mounted on an associated support surface 21, such as on a wall 22 and a disposable cartridge 90 which contains a supply of liquid soap and is removably mountable on the dispenser 25 for cooperation therewith to control the dispensing of liquid soap therefrom.

Referring also to FIGS. 3 through 6, the dispenser 25 includes a housing 30, which is preferably of unitary one-piece construction and may be formed of molded plastic. The housing 30 includes a flat rectangular base wall 31 and upstanding rectangular mounting wall 32 integral with the base wall 31 at the rear edge thereof and disposed substantially perpendicular thereto. The mounting wall 32 may have fastener holes 33 therethrough for receiving associated fasteners (not shown), securely to mount the housing 30 on the associated support surface 21. Integral with the base wall 31 and extending upwardly therefrom along the front and side edges thereof is a continuous peripheral flange 34, the front portion of which has a notch 34*a* in the upper edge thereof. Side flanges 35 are respectively integral with the side edges of the mounting wall 32 and project forwardly therefrom to join the peripheral flange 34.

Respectively integral with the side flanges 35 at the forward or distal edges thereof, and projecting laterally inwardly therefrom substantially parallel to the mounting wall 32, are two retaining rails 36, each extending along the mounting wall 32 to below the upper end of the flange 34. Integral with the base wall 31 and with the mounting wall 32 and substantially perpendicular to each are a pair of laterally spaced-apart, upstanding support plates 37, respectively provided with laterally aligned bearing notches 38 in the upper edges thereof. Formed in the base wall 31 is an elongated generally rectangular opening 39 (FIGS. 3 and 4) which extends laterally between the support plates 37, the opening 39 having a rearwardly extending rectangular arm 39*a* and having an arcuate forward end (not shown).

Integral with the housing 30 is a receptacle 40 having a peripheral wall 41 which defines the forward portion of the opening 39, the peripheral wall 41 having an arcuate front end and parallel side portions, which side portions are respectively parallel to the support plates 37 and are integral with the inner surfaces thereof at the front ends thereof. The peripheral wall 41 projects above and below the base wall 31 and is closed at its lower end by a bottom wall 42 which is disposed substantially parallel to the base wall 31. The bottom wall 42 has a circular opening 43 therein adjacent to the forward end thereof, and a generally T-shaped slot 44 therethrough (FIG. 3) just rearwardly of the circular opening 43. Respectively formed in the side portions of the peripheral wall 41 below the base 31 are two laterally aligned circular pivot openings 45 (see FIG. 5).

Integral with the rear ends of the side portions of the peripheral wall 41 and projecting laterally inwardly therefrom are two rear flanges 46, each having a notch or recess 47 at the lower end thereof. A stop web 48 laterally spans the side portions of the peripheral wall 41, extending a slight distance above and below the base wall 31, the web 48 having a rectangular notch 48*a* (FIG. 5) in the lower edge thereof. A rectangular stop web 49 is disposed substantially parallel to the stop web 48 and defines a cord across the arcuate front end of the peripheral wall 41, the upper edges of the stop webs 48 and 49 lying substantially in a common horizontal plane.

The dispenser 25 also includes a discharge assembly 50 which is removably mounted in the housing 30. The discharge assembly 50 includes a handle 51 comprising a rectangular plate 52 provided at its upper end with an inclined portion 53, which is in turn provided at its distal end with laterally outwardly extending cylindrical pivot lugs 54 In use, the handle 51 is adapted to be dropped into the housing 30 between the support plates 37 and through the opening 39 in the base wall 31, the pivot lugs 54 being respectively received in the bearing notches 38 for pivotally supporting the handle 51 for movement between actuating and retracted positions. The plate 52 has a width slightly less than the width of the opening 39, so that the base wall 31 at the rear end of the opening 39 and the rear flanges 46 of the receptacle 40 provide rear and front stops to limit the pivotal movement of the handle 51. Formed in the front surface of the plate 52 is a rectangular recess 55, in the lower end of which is formed a rectangular slot 56 which extends through the thickness of the plate 52 midway between the side edges thereof and in position so as to be disposed below the base wall 31 when the handle 51 is disposed in its mounted condition in the housing 30.

The discharge assembly 50 also includes a bias unit 60 which comprises a latch member 61 and a bias leaf 70. The latch member 61 is generally in the form of a clevis having a pair of parallel, spaced-apart arms 62, respectively provided with angled feet 63, at the lower ends thereof (see FIG. 5). The feet 63 are respectively provided with laterally outwardly extending circularly cylindrical pivot lugs (not shown) each having a substantially square key socket (also not shown) formed in the outer end thereof, which may extend laterally completely therethrough, as was illustrated in U.S. Pat. No. 4,673,109, the disclosure of which is herein incorporated by reference.

Each of the feet 63 is also provided on its inner surface with a bearing boss 66. The arms 62 are interconnected at their upper ends by a bight portion 67 provided with a forwardly extending latch flange 68 having a part frustoconical cam surface 69 thereon. The latch member 61 is dimensioned to fit within the receptacle 40 with the arms 62 respectively disposed along the inner surfaces of the side portions of the peripheral wall 41. For mounting, the arms 62 are resiliently deflected together to permit the pivot lugs to clear the inner surfaces of the peripheral wall 41, and then the latch member 61 is lowered into the receptacle 40 until the pivot lugs respectively snap out into the pivot opening 45, pivotally to mount the latch member 61. The length of the arms 62 is such that when the latch member 61 is in this mounted condition, the latch flange 68 is disposed a predetermined distance above the upper end of the receptacle 40.

The bias leaf 70 comprises a thin, flat, rectangular band which is formed of a suitable flexible and resilient material, such as a suitable plastic. One end of the bias leaf 70 is fixedly secured to the rear surface of the bight portion 67 of the latch member 61 by suitable means (not shown). The bias leaf 70 is fabricated with a predetermined curvature therein, and is provided with a curved tip 72 at its distal end which has a rectangular slot 73 therethrough for a purpose to be explained more fully below. There is also provided a key (not shown) having a lug thereon which is disposed for mating engagement in one of the key sockets to effect manual rotation of the latch member 61 about the axis of the pivot lugs, for a purpose which will be explained below.

The discharge assembly 50 also includes a pump member 80, which is generally in the shape of a rectangular, box-like, open-top frame. More particularly, the pump member 80 includes a pair of parallel rectangular side walls 81 interconnected, respectively at the forward and rearward ends thereof by a front bearing wall 82 and a rear wall 83. The rear wall 83 has an extension portion 84 which projects upwardly above the upper edges of the side wall 81 and is provided with a forwardly extending pin 85. Integral with the outer or rear surface of the rear wall 83 is a rearwardly extending rectangular positioning lug 86. The side walls 81 are interconnected at the lower edges thereof, intermediate the front and rear ends thereof by a rectangular bottom web 87. The pump member 80 is dimensioned so that it can fit between the notches 47 of the receptacle rear flanges 46, through the notch 48*a* in the stop web 48 and between the bearing bosses 66 of latch member 61 for reciprocating sliding movement forwardly and rearwardly along the bottom wall 42 of the receptacle 40 between pumping and release positions.

A plate 88 is horizontally mounted within the flange 3 and has an aperture 89 therein of irregular shape. As before seen in FIGS. 2 and 4, the aperture 89 has a circular edge portion 89*a*, straight edge portions 89*b* and 89*c*, and first and second lobe portions 89*d* and 89*e*. This plate 88 with the irregular aperture 89 serves as on part of an anti boot-leg device and is fixedly mounted inside the dispenser 25, at a predetermined height, as will be explained.

Next, the pump member 80 is mounted in the receptacle 40. For this purpose, the front end of the pump member 80 is inserted upwardly and forwardly into the receptacle 40 between the notches 47 in the rear flanges 46, the arm 39*a* of the opening 39 providing clearance for the extension portion 84 of the rear wall 83. The pump member 80 is slid forwardly through the notch 48*a* in the stop web 48 and between the bearing bosses 66 on the latch member feet 63. The bias leaf 70 is received down into the pump member 80 and the pin 85 is inserted through the slot 73 of the bias leaf 70 so that the bias leaf 70 bears against the rear wall 83 of the pump member 80.

Next, the handle 51 is mounted. For this purpose, the pump member 80 is slid forwardly against the urging of the bias leaf 70 to provide clearance so that the handle plate 52 can the dropped down through the opening 39 behind he receptacle rear flanges 46. It will be appreciated that the arms 62 of the latch member 61 bear against the rear surface of the stop web 48 to limit forward pivotal movement of the latch member 61 when the pump member 80 is slid forwardly. The handle 51 is then dropped into position with the pivot lugs 54 disposed in the bearing notches 38, as explained above. The pump member 80 is then released and it slides rearwardly under the urging of the bias leaf 70 to a normal rest position, illustrated in FIG. 3, wherein the rear wall 83 seats in the recess 55 of the handle plate 52 and bears thereagainst to hold the handle 51 in its retracted position against the rear end of the opening 39. The positioning lug 86 is received in the slot 56, effectively to prevent upward movement of the handle 5 from its mounted condition. Thus, it will be seen that the handle 51 and the pump member 80 cooperate to hold each other in their mounted conditions. In order to disassemble the discharge assembly 50, the above-described assembly procedure is simply reversed.

Referring now also to FIGS. 7–11*c* of the drawings, the cartridge 90 includes a generally box-like container 91, which may be formed of a suitable plastic material. Preferably, the container 91 is generally in the form of a rectangular parallelepiped having a top wall 92, a bottom wall 93, a front wall 94 having a cut away portion 94*a* and a lug portion 94*b*, a rear wall 95 and a pair of opposed side walls 96. The front wall 94 and the side walls 96 are set back or recessed along their lower edges adjacent to their junction with the bottom wall 93 to define a support shoulder 97. The top wall 92 projects rearwardly a slight distance beyond the rear wall 95 to form an overhang which defines a stop flange 98. Formed in the container 91 at the junctions of the rear wall 95, respectively, with the side walls 96, are two elongated longitudinal grooves 100 which extend from the level of the stop flange 98 downwardly to the bottom wall 93. The lower portion of the grooves 100 are cut away, as at 101, so as to define lugs 102 adjacent to the upper ends of the grooves 100. The top wall 92 of cartridge 90 has a receptacle 103 extending therein (see FIGS. 7 and 8) in the form of an inwardly extending cylinder having an apertured rear wall 104, thereby to establish an air passageway between the inside and outside of the container 90. Frictionally held in the receptacle 103 is a filter 105 which is a porous "Teflon" or polytetrafluoroethylene plastic sold under the trade name "Porex", for a molded porous PTFE, having a water entry point of 1.6 p.s.i. which is equivalent to 43 inches of water. The filter has an average pore size of 25 microns and a pore volume of 42%. The melting range of the filter is 314°–338° and the crystallization range is 275°–320°. "Porex" is sold by Porex Technologies of Fairburn, Ga. which publishes complete specifications for the material.

Figure 10:
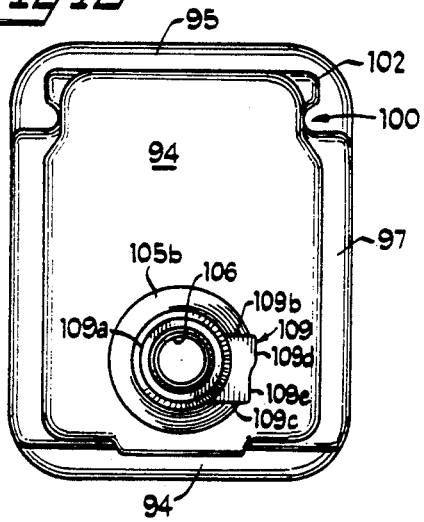
FIG. 10 is a bottom plan view of the disposable cartridge of FIG. 7.
Figure 11A:
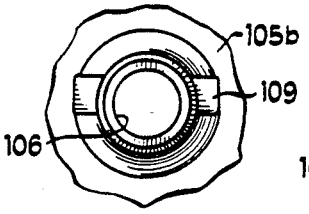
FIGS. 11A–11C are bottom elevation views of three embodiments of the anti-bootleg device of the present invention
Figure 11B:
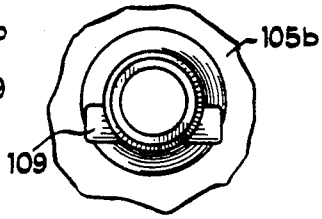
Figure 11C:
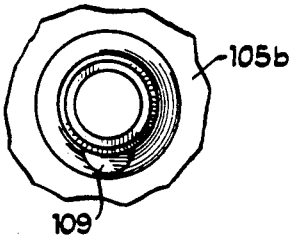

Integral with the bottom wall 93 adjacent to the forward end thereof is a cylindrical nozzle or neck 105 which projects downwardly from the bottom wall 93 and surrounds an outlet opening 106 therein (FIG. 10). A frustoconical portion 105*b* connects the flat bottom wall 93 with the cylindrical neck 105*a*. The neck 105*a* has a radially outwardly extending circumferential rib 107 forming an external thread and terminates in an annular end surface 108. Extending outwardly from the neck 105*a* is one or more irregular abutment surfaces or bosses 109 having a plurality of boss surfaces 109*a*–109*e* which are complimentary in shape to the irregular opening 89*a*–89*e* in plate 88.

Secured to the neck 105*a* and depending therefrom is a compressible nipple 110 having an annular flange (not shown) at the upper end thereof which is integral with an upstanding cylindrical wall adapted to surround the lower end of the neck 105*a* and abut against the circumferential flange. The nipple 110 is provided with a normally-closed discharge slit 113 at its distal end. Trapped between the flange and the end surface 108 of the neck 105*a* is a check valve assembly (not shown), the parts being clamped together by a cylindrical retainer clip 116 which securely holds the nipple 110 and the valve assembly on the neck 105. The construction, assembly and operation of the neck 105, the nipple 110 and the valve assembly are all described in U.S. Pat. Nos. 4,673,109 and 4,886,192.

Preferably, the cartridge 90 is inexpensive to manufacture so as to be disposable. The container 91 is filled with liquid soap by the manufacturer or supplier of the cartridge 90 and the nipple 110 is then mounted in place. It is a significant aspect of the invention that the cartridge 90 and the filter 105, if of a specific size, permits the dispenser to be activated many times without establishing a vacuum that distorts the cartridge 90. In mounting the cartridge 90, it is placed over the dispenser 25 with the neck 105*a* disposed downwardly. The cartridge 90 is slid down along the mounting wall 32, with the retaining rails being respectively received in the longitudinal grooves 100. As the cartridge 90 is lowered into its use position, the nipple 110 extends downwardly into the receptacle 40 between the stop webs 48 and 49 and in coaxial alignment with the circular opening 43 in the bottom wall 42.

In its normal rest condition, the latch flange 68 of the latch member 61 projects forwardly beyond the stop web 48 so as to obstruct the path of the neck 105. More particularly, the lower end of the retainer clip 116 engages the cam surface 69 and cams the latch member 61 into pivotal movement rearwardly to accommodate passage of the retainer clip 116. As soon as the retainer clip 116 has moved past the latch flange 68, it snaps back forwardly under the urging of the bias leaf 70 into the space between the circumferential rib 107 and the circumferential flange 108 for engagement with the latter to prevent retrograde movement of the cartridge 90. As soon as the retainer clip 116 cams past the latch flange 68, the lower end of the retainer clip 116 seats on the upper edges of the stop webs 48 and 49 to support the cartridge 90 in its normal mounted or use position, illustrated in FIG. 3, in which position the lower end of the nipple 110 projects a very slight distance below the bottom of the receptacle 40 through the circular opening 43 therein.

The container 91 is dimensioned so that when the cartridge 90 is disposed in its use position on the dispenser 25, the upper edge of the peripheral flange 34 of the housing 30 is disposed for engagement with the support shoulder 97 of the container 91 and the upper edge of the mounting wall 32 is disposed for engagement with the stop flange 98. Preferably, the stop flange 98 wraps around the sides of the container 91 for engagement with the upper ends of the side flanges 35 of the housing 30. The parts are all dimensioned so that when the cartridge 90 is disposed in its use position on the dispenser 25, the outer surfaces of the front wall 94 and the side walls 96 are, respectively, substantially coplanar with the corresponding portions of the outer surface of the housing peripheral flange 34, and the outer surface of the side walls 96, are respectively substantially coplanar with the outer surfaces of the housing side flanges 35 so as to present an attractive, smooth outward appearance. Additionally, the front lug **94*b* fits within and rests upon the notch 34*a* in the front wall 34. It will be appreciated that when the cartridge 90 is disposed in its use position, the lugs 102 engage the upper ends of the retaining rails 36, effectively to prevent forward tilting movement of the cartridge 90 with respect to the dispenser 25**.

The venting of the container 91 through the receptacle 103 and filter 105 prevents too large a vacuum from being established in the container and permits, for the first time, dispensing many consecutive doses of soap of substantially the same volume without distorting the sides 96 of the container 91. It has been determined that for a one liter volume container the filter 105 of "Porex" (25 micron material) should be ¼" in diameter and not longer than about 5/16". The filter 105 is slightly larger than the receptacle 103 so a good friction fit occurs to prevent the filter 105 from falling out of the receptacle. The resistance of the filter 105 should be enough to establish about 4–5" vacuum when the soap level is above the filter 105 (to prevent soap leaking from the nipple 110) but at no time should the filter 105 prevent sufficient replacement of air after a dispensing operation so that the vacuum exceeds about 12", at which level the side walls 96 distort. Use of the Porex® material is important because even after the level of soap has dropped below the receptacle 103 and filter 105 contained therein, there is still a slight negative pressure in the container 91, which limits or entirely prevents soap dripping from the distal end of the nozzle 110 at the slit 113. This is very important commercially since one of the biggest complaints about soap dispensers is the mess which some create.

The check valve assembly (not shown) normally permits liquid soap to flow downwardly through the neck **105*a* to fill the nipple 110 with a charge of liquid soap. In order to dispense this charge of liquid soap, a user places his palm under the nipple 110 and pulls the handle 51 forwardly to its actuating position with his fingers. This drives the pump member 80 forwardly to its pumping position and into engagement with the nipple 110, compressing it and ejecting the charge of liquid soap therefrom through the discharge slit 113, this compression also serving to close the check valve assembly to prevent liquid soap from flowing back up from the nipple 110 into the neck 105. When the handle 105 is released, the pump member 80 returns to its release position and the handle 51 is returned to its retracted position under the urging of the bias leaf 70. The check valve assembly reopens to permit a new charge of liquid soap to flow into the nipple 110. When the cartridge 90** is spent, it is removed by the serviceman, as described in the '109 patent.

The anti-bootleg feature of this invention represents an advance in the art and requires cooperation between the plate 88 and irregular opening 89 therein and the irregular abutment surfaces or bosses 109 on the cartridge container 91. Although complimentary plate openings are not illustrated for the alternative configuration of FIGS. **11*a*–11*c*, it should be readily apparent that various configurations are available to permit one distributor to have a "proprietary" dispenser/cartridge combination. Again, commercially this is of paramount importance because "bootleg" refillers abound and distributors are continually trying to protect their customers. By moving bosses 109 around the circumference of the neck 105*a* various different "proprietary" dispenser/cartridge combinations can be made. In order to bootleg the device 20, the plate 88 would have to be altered. If a cartridge 90 without the appropriate bearing surfaces is used, the cartridge 90 will not fit into the plate 88 far enough for the pump member 80 to contact the entire portion of nipple 110** and the system will not operate correctly resulting in little soap being dispensed.

From the foregoing, it can be seen that there has been provided an improved soap dispensing system which is simple and economical construction, utilizing a dispenser which carries a discharge assembly and a disposable liquid soap cartridge removably mountable on the dispenser, wherein the cartridge is automatically latched in position on the dispenser to prevent unauthorized removal thereof, and the parts of the discharge assembly are few can be readily assembled and disassembled without the use of tools, and retain themselves in the assembled mounted condition without any fastening means. The dispensing system enables repeated operation of the dispenser without establishing a vacuum in the soap cartridge which distorts the cartridge and includes an anti-bootleg device permitting several proprietary combinations to be used.

We claim:

1. In a liquid soap dispensing system including a housing and a discharge mechanism carried thereby for movement between a normal retracted configuration and an actuating configuration for dispensing repeated doses of liquid soap from an associated cartridge having a wall, the improvement comprising: a receptacle positioned in said cartridge wall forming an air path between the inside and outside of the cartridge, a means comprising a plastic filter frictionally disposed within said receptacle for permitting air to flow into the cartridge but preventing soap from flowing out of the cartridge, and means permitting sufficient air flow into the cartridge to limit the vacuum therein to not greater than about 12" of water upon repeated operation of the discharge mechanism.

2. The liquid soap dispensing system of claim 1, wherein the wall having the receptacle thereon is the back wall of the soap cartridge, the receptacle disposed below the soap level when the cartridge if full.

3. The liquid soap dispensing system of claim 1, wherein the means comprising the filter is such to establish a vacuum of about 4" to about 5" of water when the soap level is about the filter.

4. The liquid soap dispensing system of claim 3, wherein the plastic filter prior to disposition in the receptacle is larger than the receptacle so that the filter has to be compressed to be inserted into the receptacle and the filter frictionally engages the receptacle.

5. The liquid soap dispensing system of claim 4, wherein the filter is made of polytetrafluorethylene having an average pore diameter of about 25 microns.

6. The liquid soap dispensing system of claim 5, wherein the filter is molded in the form of a cylinder.

7. A liquid soap dispenser having only a minimal number of parts which can be assembled without the use of fastening means for dispensing repeated doses of liquid soap from an associated cartridge with a compressible outlet nipple without collapsing the side walls of the cartridge, said dispenser comprising a housing member adapted to receive the associated cartridge with the nipple, a pump member freely receivable in housing member and movable therein between a pumping position for compressing the nipple to discharge liquid soap therefrom and a release position out of engagement with the nipple, a handle member carried by said housing member in a supported condition for engagement with said pump member, said handle member in its supported condition being pivotally movable between an actuating position for driving said pump member to its pumping position and a retracted position for accommodating movement of said pump member to its release position, said pump member and said handle member cooperating when engaged to retain said pump member in said receptacle and to retain said handle member in its supported condition, and a bias unit engageable with said housing member and said pump member for resiliently urging said pump member to its release position and into engagement with said handle member, thereby to urge said handle member to its retracted position, said cartridge including a blow molded thin walled plastic container with an externally threaded neck for connection to the compressible nipple and a rear wall, a receptacle positioned in the rear wall of the cartridge adapted to receive a filter therein, a means comprising a plastic filter in said receptacle establishing an air path between the inside and outside of said cartridge, said filter having an average pore diameter of about 25 microns such that upon repeated activation of said pump member the means comprising the filter limits the vacuum inside said cartridge to not greater than 12" of water.

8. The liquid soap dispenser of claim 7, wherein the filter is cylindrical in shape about ¼" in diameter and about 5/16" in length.

9. The liquid soap dispenser of claim 8, wherein the receptacle has an apertured end wall inside the cartridge against which the filter rests.

10. The liquid soap dispenser of claim 9, wherein said cartridge rear wall fits close to said housing member to prevent tampering with said filter.

11. The liquid soap dispenser of claim 10, wherein said bias unit includes a latch portion engageable with the associated cartridge for locking it in position.

12. The liquid soap dispenser of claim 11, wherein each of said housing member and said pump member and said handle member is of unitary one-piece construction.

13. The liquid soap dispenser of claim 12, wherein said bias unit is releasably snap-fitted into engagement with said housing member.

14. A liquid soap dispenser for dispensing repeated doses of liquid soap from an associated cartridge with a compressible outlet nipple without collapsing the side walls of the cartridge, said dispenser comprising a housing member adapted to receive the associated cartridge with the nipple, a pump member freely receivable in housing member and movable therein between a pumping position for compressing the nipple to discharge liquid soap therefrom and a release position out of engagement with the nipple, a handle member carried by said housing member in a supported condition for engagement with said pump member, said handle member in its supported condition being pivotally movable between an actuating position for driving said pump member to its pumping position and a retracted position for accommodating movement of said pump member to its release position, said pump member and said handle member cooperating when engaged to retain said pump member in said receptacle and to retain said handle member in its supported condition, a bias unit engageable with said housing member and said pump member for resiliently urging said pump member to its release position and into engagement with said handle member, thereby to urge said handle member to its retracted position, a horizontally extending plate having an irregularly shaped aperture therein fixedly mounted in said housing spaced from said nipple with a portion of said aperture in registry with said nipple, said cartridge comprising a blow molded thin walled plastic container with a parallelpiped body portion having a rear wall and an externally threaded cylindrical neck extending therefrom and connected to the compressible nipple, a receptacle positioned in the rear wall of the cartridge adapted to receive a filter therein, a means comprising a polytetrafluorethylene plastic filter in said receptacle establishing an air pathway between the inside and outside of said cartridge for preventing a vacuum exceeding 12" of water from developing inside said cartridge upon repeated successive operation of said pump member, said cartridge having a frustoconical portion connecting the cylindrical neck to the body portion and at least one boss extending perpendicularly to said cylindrical neck intersecting said frustoconical portion, the irregularly shaped aperture forming a seat to receive therein said cartridge frustoconical portion and said boss extending therefrom and to position said cartridge such that said nipple is in position to be contacted by said pump member.

15. The liquid soap dispenser of claim 14, wherein there are two boxes extending outwardly from said cartridge neck.

16. The liquid soap dispenser of claim 15, wherein both bosses intersect said frustoconical portion.

17. The liquid soap dispenser of claim 14, wherein there are at least two bosses each having a different shape.

18. The liquid soap dispenser of claim 14, wherein one boss is rectangular in plan view and one boss is arcuate in plan view.

* * * * *

UNITED STATES PATENT AND TRADEMARK OFFICE

CERTIFICATE OF CORRECTION

PATENT NO. : 5,174,476

DATED : December 29, 1992

INVENTOR(S) : Robert L. Steiner et al.

It is certified that error appears in the above-indentified patent and that said Letters Patent is hereby corrected as shown below:

Col. 11, line 8, "if" should be --is--.
Col. 11, line 12, "about" should be --above--.

Col. 12, line 58, "boxes" should be --bosses--.

Signed and Sealed this

Fifteenth Day of February, 1994

*Attest:*

*Attesting Officer*

BRUCE LEHMAN

*Commissioner of Patents and Trademarks*